US005787617A

United States Patent [19]

Testa

[11] Patent Number: 5,787,617

[45] Date of Patent: Aug. 4, 1998

[54] PERSONALIZED PHOTO/EVENT DISPLAY DEVICES

[76] Inventor: Richard J. Testa, 352 Lanning Rd., Honeoye Falls, N.Y. 14472

[21] Appl. No.: 327,485

[22] Filed: Oct. 21, 1994

[51] Int. Cl.[6] ..... G09F 1/10

[52] U.S. Cl. ..... 40/124.06; 40/124.191; 40/775; 281/38

[58] Field of Search ..... 40/124.1, 158.1, 40/159, 489, 64, 774; 283/65, 63, 117; 281/22, 26, 32, 51, 38, 37, 31; 402/79

[56] References Cited

U.S. PATENT DOCUMENTS

| | | | |
|---|---|---|---|
| 816,870 | 4/1906 | Markoff | 40/124.1 |
| 1,028,921 | 6/1912 | Wagner . | |
| 1,168,392 | 1/1916 | Gruettner . | |
| 1,214,867 | 2/1917 | Young | 40/615 X |
| 2,489,240 | 11/1949 | Meyer . | |
| 2,492,906 | 12/1949 | Voges | 446/152 |
| 4,622,768 | 11/1986 | Moreau | 40/124.1 |
| 4,662,093 | 5/1987 | Suttles et al. | 40/774 X |
| 4,828,421 | 5/1989 | Arakaki . | |
| 4,991,767 | 2/1991 | Wyant . | |
| 5,031,935 | 7/1991 | D'Andrea . | |
| 5,096,752 | 3/1992 | Wagner . | |
| 5,238,345 | 8/1993 | D'Andrea . | |

FOREIGN PATENT DOCUMENTS

| | | | |
|---|---|---|---|
| 10060 | 8/1899 | United Kingdom | 281/38 |

*Primary Examiner*—Cassandra H. Davis
*Attorney, Agent, or Firm*—Eugene Stephens & Associates

[57] ABSTRACT

In a first embodiment, a photograph is held between two panels of a multi-panel display device and viewed through a die cut in the outer panel. The outer panel has graphics printed around the die cut in such a way as to give the appearance of interaction between the subject of the photograph and the scene depicted in the graphics. In second and third embodiments, the display device is in the form of an album containing multi-layered pages which hold photographs between their layers. The photos are viewed through die cuts in the outer layers of the pages. The pages have graphics printed on their pages which give the appearance of interaction between the subjects of the photos and the graphics printed on the pages. The die cuts and graphics can be formed such that the face of a subject of a photograph appears in place of the face of a character depicted in the graphics. An audio storage device can be included to deliver an audio message to accompany the photos and graphics. The proper method for taking the photographs is included with the display devices to ensure proper size of the images of the subjects for optimum display.

15 Claims, 4 Drawing Sheets

PERSONALIZED PHOTO/EVENT DISPLAY DEVICES

BACKGROUND OF THE INVENTION

In the U.S. alone, over 18 billion pictures are taken annually. A few examples of the way people use photographs are to record inventories of their belongings, to record special events in their lives (such as weddings, holidays, birthdays, etc.), and to record travel experiences. As a result of the number of pictures taken annually, there is considerable demand for such items as photo frames, photo albums, and other photo related products.

The photo/event display devices of the instant invention provide users the opportunity to enhance the display of their photographs. The subject(s) of the photographs contained in the display devices appear to be part of specific events, locales, or stories depicted in the devices. This allows users to have more personalized recollections of the events or locales. For example, the display devices may depict scenes from motion pictures, theme parks, stylized events with favorite fictional or nonfictional characters, or many other scenarios.

Related photo display devices are found in the prior art. See for example U.S. Pat. No. 4,828,421 to Arakaki. Arakaki discloses a personalized photo album which has a specialized recess in each of its front and back covers. The owner can insert personal indicia, such as a photograph, in each recess to clearly associate the album with him- or herself. This is the extent of the personalization of the photo album and does not give the appearance of photo subject interaction with scenes depicted on the album's pages as does the instant invention.

In U.S. Pat. No. 4,991,767, Wyant discloses a portfolio with a cover that can display selected photographs. The cover of this portfolio has a transparent film over it. The user places photographs between the film and the cover such that the photographs are visible through die cuts in the cover when the cover is closed. Wyant does not disclose the inclusion of graphics to give the appearance of interaction between the subjects of the photos and the scenes depicted in the graphics.

D'Andrea discloses a specialized book in U.S. Pat. No. 5,031,935. The book includes superimposed die cuts in its pages, as well as a cover which provides a recessed area for a mirror or display of photographs on its outer surface. A user places a photograph on the inside front and/or back cover such that the photograph is visible through the die cuts. The die cuts are cut through the entire thickness of each page and can be placed to give the appearance of limited interaction between the subject of the photograph and the scenes depicted in the book. However, because the die cuts are made through the entire thickness of each page, a different scene must appear on each side of the page to avoid destroying part of the scene on a page with a die cut. The scenes in the book are portrayed by drawings, such as line drawings or the like. While these illustrations do suggest limited interaction with the scenes they depict, they do not provide the realism photographic or photo-realistic images would.

The recessed area of the cover of D'Andrea's book provides for the display of a mirror. The mirror can be made from sheet metal, coated glass or polymers, or any other suitably reflective material. D'Andrea also mentions in passing that a way of displaying "an image of [a] child . . . is also contemplated," but does not disclose in any detail how this might be accomplished.

A specimen found on the market, a hard cover book produced by Picture Me Books, Inc., has a die cut in the cover located at the same point as the die cuts in the pages of the book. A photo on the inside back cover can be viewed through this die cut, or a different photo can be inserted into the cover for viewing. If the user wishes to insert a different photo, he or she spreads the layers of the cover and inserts the new photo. There is no way to hold the photo in place other than the friction exerted by the layers of the cover.

In U.S. Pat. No. 5,096,752, Wagner discloses a place mat which provides for the display of a card. The place mat has a transparent front panel through which photographs and/or card inserts selected by the user can be viewed. The card inserts can display graphics related to the photos displayed. The appearance of interaction of involvement of the subjects of the photos and cards is not contemplated.

In a later patent to D'Andrea, U.S. Pat. No. 5,238,345, a method of making a publication is disclosed. The publication, such as a book, contemplated is geared specifically toward association with team sports and provides for the display of a photograph in such a format that it appears that the subject of the photograph is part of a scene depicted in the book. The scene is typically an artist's rendering of a portion of a game played by a particular team. As in her earlier book, D'Andrea uses superimposed die cuts in the pages of the book. A photograph is placed on the inside back cover. The die cuts are situated so that the photograph can be seen there through. Graphics are placed around the die cuts so that it appears that the subject of the photograph is part of the scene(s) depicted.

The book disclosed in the second D'Andrea patent has many of the same disadvantages as the first. The Number of photographs that can be used is limited to one, and the same photograph appears on the pages of one side of the book. Use of one photo also limits the types of scenes that can be depicted on the pages of the books. The illustrations are drawings as in the books of the first patent and do not give the realism that photographic or photorealistic images would. This particular format is actually slightly more limited than the first book since the die cut in the cover is not easily used to display a photo other than that on the inside back cover. Further, the die cuts in the pages of D'Andrea's publication destroy part of the graphics on one side of each page.

A specimen of this book is found on the market and is produced as a soft cover book by Picture Me Books, Inc. The front cover is a single layer of material and does not include a way to insert a photograph other than the photograph on the inside back cover for viewing when the book is closed. Additionally, the back cover uses multiple folded panels to allow placement of and to hold in place a photograph rather than insertion between two glued layers, which is disadvantageous in a book format. While this arrangement allows for easy placement of the photo, it is not secure since no way is provided to hold the photo or to hold the panels closed.

None of the prior art photograph display devices include instructions for taking a photograph which will yield an image optimally sized for use in an associated display device. This could often result in the improper or inadequate display of the photo. The user may also resort to taking a number of photos on a hit-or-miss basis until an appropriately sized photo is obtained, resulting in increased costs to the user. Additionally, sample images giving examples of photo composition and image size are not provided in the prior art. Users who have little knowledge of good photograph composition would thus have little chance of taking a photograph that is composed appropriately.

SUMMARY OF THE INVENTION

In one embodiment of the invention, a photograph is affixed to an internal surface of a multi-panel greeting card. A die cut is provided in the card to allow the photograph to be seen when the card is closed. Graphics are printed around the die cut on the outer panel of the card such that the subject of the photograph appears to be involved with the scene depicted in the graphics. The die cut can be shaped and the graphics can be formed such that the face of the subject of the photograph appears in place of the face of a character depicted in the graphics. A sample image can be printed on the inside of the card to provide users an example of proper photo composition, size, and placement.

In another embodiment, photographs are displayed in an album format in which the invention overcomes many of the disadvantages of the prior art. The album format of the invention allows the use of more photos than prior art display devices to give the appearance of interaction with a number of different types of scenes, as well as more variety. The pages of the instant photo album can each display a photograph in such a way that the subject appears to be interacting with scenes depicted thereon. The die cut on a given page can often protrude over the photo displayed, enhancing the apparent interaction of the subject with the depicted scene. Again, each die cut can be shaped and each graphic can be formed such that the face of the subject of the photograph appears in place of the face of a character depicted in the graphics. Sample images can be printed on the inside of selected pages to provide users with examples of proper photo composition, size, and placement.

A method of taking a photograph to ensure that the image will be properly sized for display is included with all embodiments of the invention. This enables the user to take a series of four photographs of which one or more will be suitable for display instead of resorting to trial and error as with prior art display devices. The result is a savings of time, energy, and cost in addition to a photograph which is properly sized for the display device. Further, the inclusion of sample images in the display devices results in the taking of better composed photographs. Users can realize even more savings since they get photographs with which they are satisfied, resulting in fewer photos that need to be taken.

DETAILED DESCRIPTION OF THE PREFERRED EMBODIMENT

The following description of the invention is provided for illustrative purposes only. It is not the intent of the inventor to limit the invention to the particular examples described below.

Figure 1:
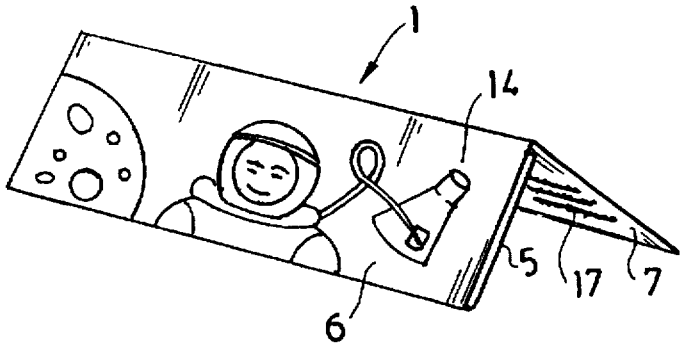
FIG. 1 is a view of a first embodiment of the invention.
Figure 2:
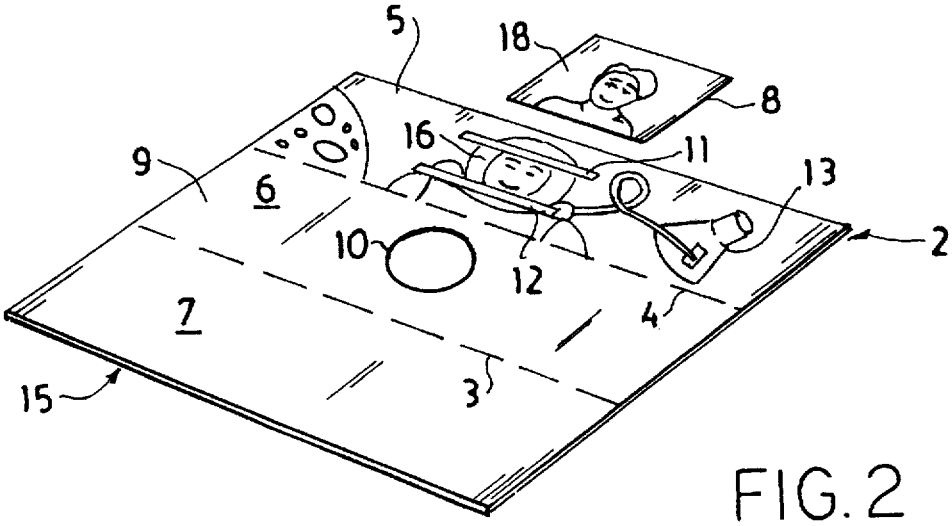
FIG. 2 is another view of the first embodiment of the invention in a completely open state.

In a first embodiment of the invention, as seen in FIGS. 1 and 2, the display device 1 has three panels formed from a single piece of material 2. In a preferred embodiment, the panels are of substantially equal dimensions and the material used is card or board stock. In general, the panels need not be of equal dimensions and other materials can be used. The panels are created by two parallel creases 3, 4, the first panel 5 folding over the second center panel 6, and the third panel 7 folding over the other two when they are folded together. A photograph 8 is affixed to the top surface 9 of the piece of material 2 in the region comprising the first panel 5 such that the photograph 8 is visible through a die cut 10 in the second panel 6 when the display device 1 is closed. The photo 8 can be affixed by the action of the panels themselves. In a preferred embodiment, the photo 8 is affixed to the first panel 5 with pre-applied fugitive or easy release adhesive strips 11, 12 or their equivalent, which are preferably covered by a removable liner.

First graphics 13 are printed on the top surface 9 of the piece of material 2 on the first panel 5, and second graphics 14 are printed on the bottom surface 15 of the piece of material 2 on the second panel 6. The first and second graphics 13, 14 are substantially identical and are aligned so that the subject of the photograph 8 appears to be involved or interacting with the scene depicted in the graphics on the second panel 6. The first graphics 13 can include a blank spot or sample image 16 superimposed with the die cut 10 of the second panel 6 to assist in the proper placement of the photograph 8 for optimum display or to show a user how the photograph 8 should be used and/or composed. The die cut 10 can be shaped and first and second graphics 13, 14 can be formed such that the face of the subject of the photograph 8 appears in place of the face of a character shown in the first and second graphics 13,14. The third panel 7 can have a type of message conveyance 17, such as a pre-printed message thereon, or can be left blank so that the user can write a message of his or her choosing.

The first and second graphics 13, 14 can be photographic or photo-realistic images printed on the piece of material 2. This enhances the appearance of interaction between the subject of the photograph 8 and the scene depicted in the graphics 13, 14, providing an element of realism not found in the prior art display devices. To further enhance realism, the background 18 of the photograph 8 can be substantially identical to the graphics 13, 14. The background 18 in this case could be a large poster or the like, and the subject would stand in front of the background while a person with a camera takes the photograph. Alternatively, the background and the image of the subject can be digitized images, the two images being combined using digital image processing equipment of some sort. For example, the images could be combined with a microcomputer using software such as ADOBE™ PHOTOSHOP™.

This embodiment of the invention allows enhanced display of the photograph 8. The display device 1 can be sized to accommodate photographs of many sizes, such as 4 inches by 6 inches, 3½ inches by 5 inches, "wallet" sized photos, or such other sizes as may be appropriate. The display device 1 can also be sized such that it can be used as a greeting card and/or placed into photo frames along with the photos they contain. The display device 1 is accompanied by instructions for photographic techniques which will yield photos optimally sized for display in the display device. A method for doing this is described below.

Figure 3:
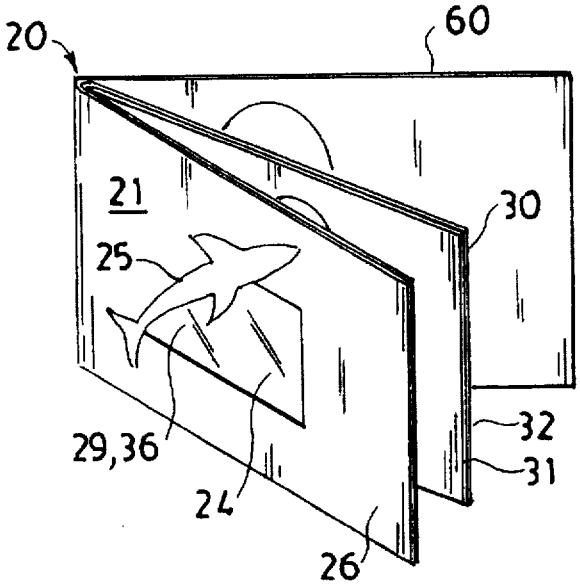
FIG. 3 is a view of a second embodiment of the invention.
Figure 4:
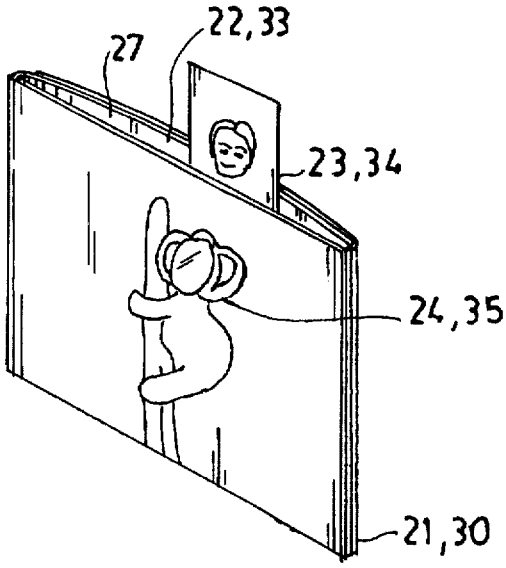
FIG. 4 is another view of the second embodiment of the invention, illustrating the construction of a page and the placement of a photograph in the page.
Figure 5:
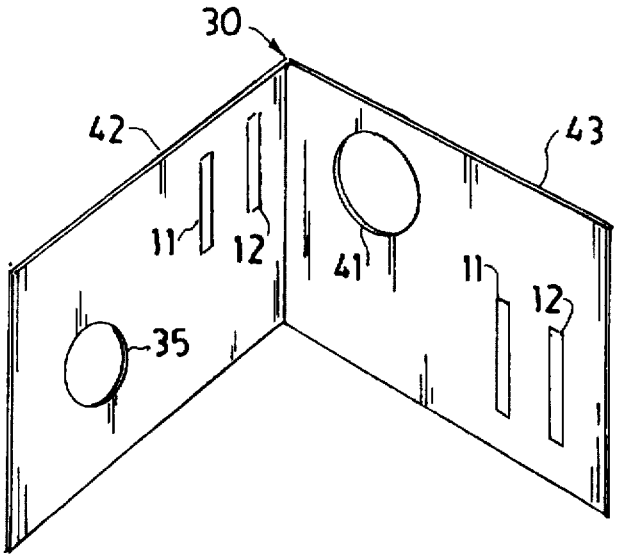
FIG. 5 is a view of a page according to the invention as used in the second embodiment of the invention and illustrating a variation of the page comprising a third embodiment of the invention. The page is shown with its layers separated.

In a second embodiment, shown in FIGS. 3–5, the display device 1 takes the form of a photo album 20. The front cover 21 of the photo album 20 is made with at least two layers 201,202 of material, such as card stock. The layers 201,202 of the edger are joined at least at the edges with an adhesive or the like, but a section of at least one edge is not affixed to create an opening 22. The user inserts a photograph 23 through opening 22 by spreading the layers 201,202 of the cover 21. A die cut 24 is provided in the outer layer 201 of the front cover 21. The user slides the photo 23 between the layers 201,202 to position it for viewing through the die cut 24. A transparent or translucent film 29 can also be provided over the die cut 24 to protect the photo 23 from damage. First graphics 25 are provided on the outer surface 26 of front cover 21 around the die cut 24. The die cut 24 can be shaped to allow the scene depicted in the first graphics 25 to protrude over the photo 23 to enhance the appearance of involvement of the subject of the photo 23 with the scene depicted in the first graphics 25. In this case, the protrusion can be a portion of a character or object depicted in the graphics, such as a hand or head, or even an entire character or object appearing next to a subject of the photograph. The protrusion can also simply follow the outline of a character or object. For example, a whale might be depicted in the graphics as jumping over the die cut. The die cut could be shaped so that it followed the belly of the whale, but still allow the photo to be viewed with relatively little obstruction.

Second graphics 27 are printed on an internal surface 203 of one of the layers 202 of the cover which can be substantially identical to or substantially matching or substantially matches first graphics 25. If the second graphics 27 are not substantially identical to the first graphics 25, they can include a sample image showing the user how to compose and/or use a photograph to be displayed in the display device 1. The photo 23 is placed over the second graphics 27, and the second graphics 27 can include a blank spot to aid in proper alignment of the photograph. The die cut 24 can be shaped and first and second graphics 25, 27 can be formed such that the face of the subject of the photograph 23 appears in place of the face of a character shown in the first and second graphics 25, 27.

Figure 10:
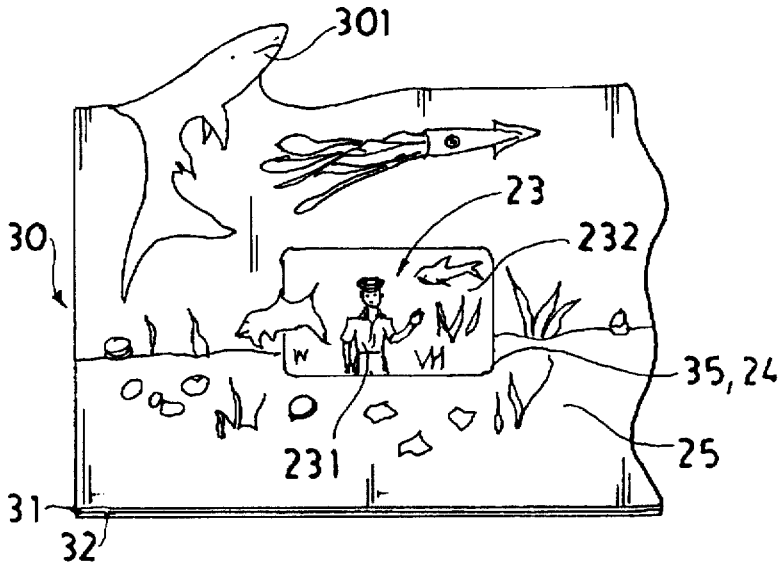
FIG. 10 is a view of a page according to the invention as used in the second embodiment of the invention and illustrating a variation of the page in which the page is at least partially in the shape of a character depicted in graphics on the page.

The pages of the second embodiment of album 20 are constructed in a manner similar to that of the cover of the album. Each page 30 of the album is constructed of at least two layers 31, 32 joined at least at the edges of the layers. Each page 30 can be formed to follow an outline of an image depicted in the graphics 25. For example, the page 30 as seen in FIG. 10 can be formed to follow the outline of the image 301. One edge of each page 30 is at least partially unsealed to leave an opening 33 for insertion of a second photo 34 between the layers of the page 30. Opening 33 can be sized to accommodate photographs of many sizes, such as 4 inches by 6 inches, 3½ inches by 5 inches, "wallet" sized photos, or such other sizes as may be appropriate. A die cut 35 is provided on one side of the page 30 to allow viewing of photo 34. As on the front cover 21, a transparent or translucent film 36 can be affixed over the die cut 35 to protect the photo 34 from damage. This arrangement allows the user to insert a different photo on each page of the album to give a greater variety of scenes in which the subject may appear to be involved and allow more memories to be preserved. This construction also allows the inclusion of a die cut 35 on one side of a page 30, while the other side of the page 30 is whole and free of potentially interfering die cuts. This allows the depiction of a single scene in the graphics of facing pages without destroying the graphics on one page as would occur in many of the prior art display devices. The album is accompanied by instructions for photographic techniques which will yield photographs optimally sized for display in the album as described below.

Figure 8:
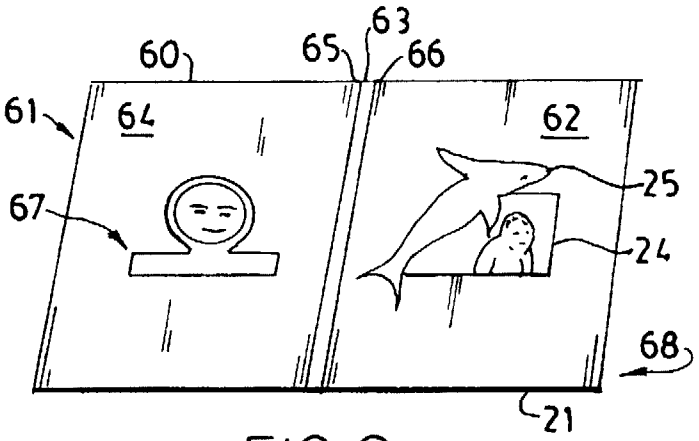
FIG. 8 is a top view of a piece of material from which album covers of the invention are made.
Figure 9:
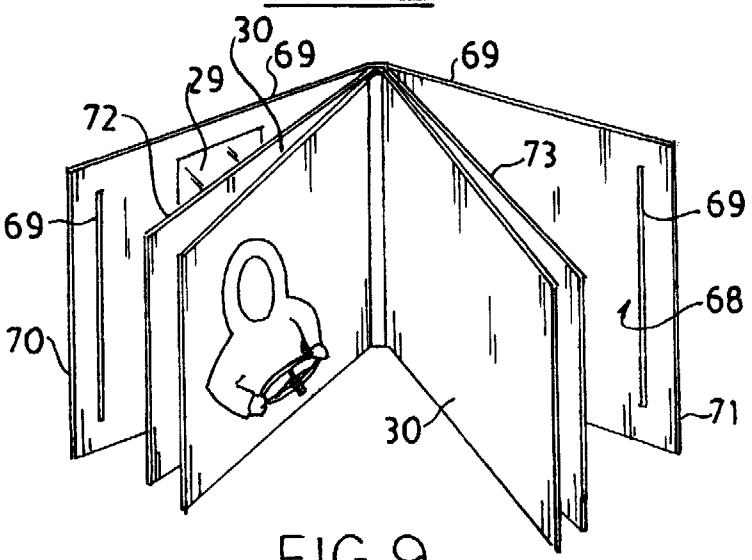
FIG. 9 illustrates the construction of an album of the invention.
Figure 6:
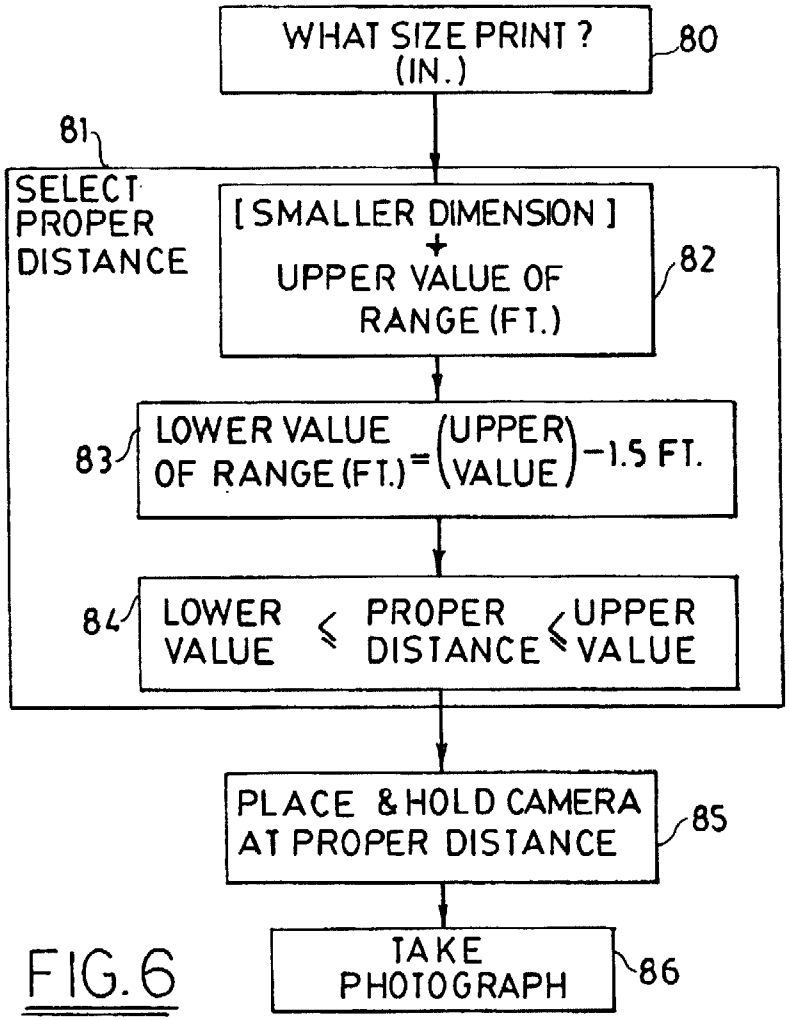
FIG. 6 is a flow chart of the method of using the invention.
Figure 11:
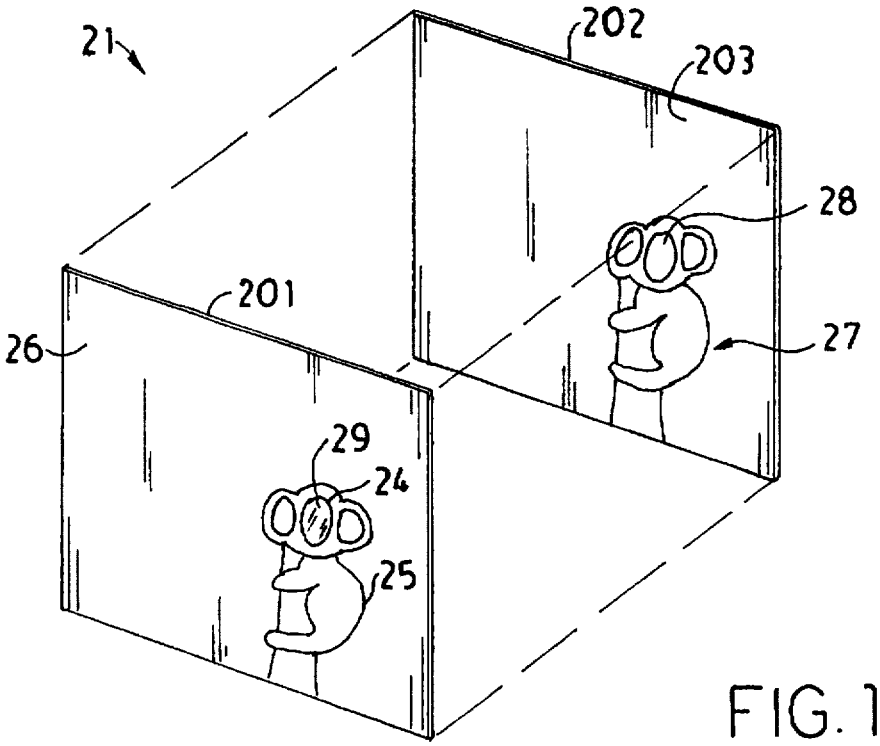
FIG. 11 is an exploded view of a cover or page according to the invention showing the graphics that appear on an internal surface thereof.

The front and back covers 21, 60 of the album are made from a single piece of material 61 in a fashion very similar to that of the first embodiment of the invention as illustrated in FIGS. 8 and 9. The piece of material 61 is divided into three panels 62, 63, 64 by two parallel creases 65, 66. The first and third panels are substantially equal in size. The second panel, located between the other two, is sized according to the number of pages to be included in the photo album. The first graphics are printed on the covers on the top surface 67 of the piece of material 61. On the bottom surface 68, adhesive 69 is applied along at least two edges 70, 71 of the first and third panels; and the film 29 can be applied over the die cut 24 in the front cover 21. Pages 30 are inserted with one edge along the second panel; and the first and third panels are folded against layers of material 72, 73 attached to the first and last pages, respectively, to form the album.

As in the first embodiment of the invention, the backgrounds of the photographs can be substantially identical to the graphics of respective pages to enhance the appearance of interaction between the subjects of the photos and the scenes depicted in the graphics. An example of this is shown in FIG. 10 in which the background 232 of the photo 23 is substantially identical to the graphics 25 carried on a page 30, creating the impression that the subject 231 of the photo 23 is interacting with a scene depicted in the graphics 25 and the background 232. The background can be a poster or the like or a digitized image combined with the digitized image of the subject with digital image processing equipment.

In a third embodiment of the invention, each page 30 of photo album 20 has two die cuts 35, 41, one on each side of the page 30. FIG. 5 shows the page 30 opened up so that the interior surfaces of the layers 42, 43 are visible. The page 30 can be constructed from two or three layers, but the outer layers in either case are the layers in which the die cuts 35, 41 are provided. This arrangement allows the display of even more photos, one on each side of a given page, without the destructive effect found in the prior art. The die cuts 35, 41 can be shaped and the first graphics formed such that the face of a subject of a given photo appears in place of the face of a character depicted in the photo. As in the second embodiment, transparent or translucent film can be affixed over the die cuts 35, 41 to protect the photos displayed. Again, the album is accompanied by instructions for photographic techniques which will yield photographs optimally sized for display in the album.

Figure 7:
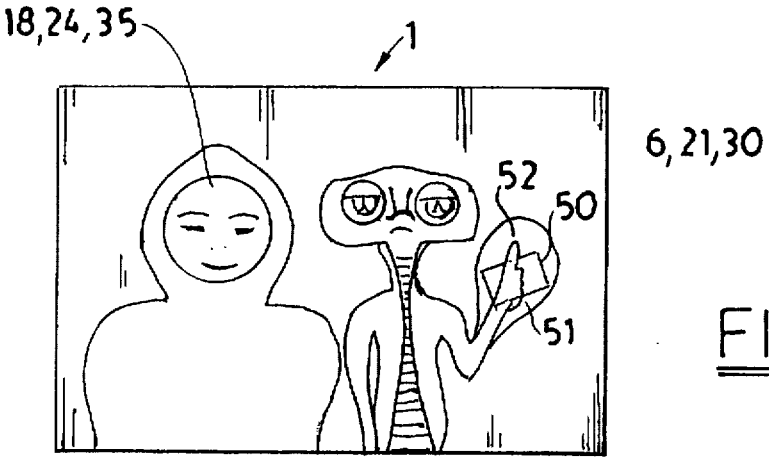
FIG. 7 shows an example of the inclusion of an audio signal storage and playback device in the display device of the invention.

All of the embodiments can additionally use an audio signal storage and playback device 50, such as a voice chip, for storing and reproducing an audio input signal substantially as illustrated in FIG. 7. The chip 50 can be used to record the voice of a user and/or music or to store a pre-recorded audio signal, to be played back when the display device is used. A switch 52 can be attached to the chip 50 such that when the display device is opened, the chip 50 plays its stored audio signal. Alternatively, the chip 50 can be placed in a piece of material 51, such as plastic; and playback can be triggered by exerting pressure on a pressure-sensitive switch 52 or the like by pressing the material. For example, the chip 50 can store a sound clip from a well-known movie and be embedded in a plastic likeness of a character from the movie. Depressing a part of the plastic likeness, the head for example, can cause the chip 50 to play the sound clip. The piece of material 51 need not include an audio signal storage and playback device. Instead, the piece of material 51 can be included to enhance realism of the scene depicted in the display device 1.

A method of taking a photograph is included with all embodiments of the invention. This method ensures proper image size in photographs in which the faces of the subjects will be substituted for the faces of characters depicted in the graphics of the display devices. As a result of the use of this method, the user is required to make fewer attempts at getting the right image size. The user benefits by a reduction of time, energy, and cost expended in his or her attempts to achieve the proper image size. This is a distinct advantage over the prior art since no such method is provided with any other prior art display device.

In the first step of the method, the user must determine the lens and film size of the camera to be used. Then, the user must decide what size print will be displayed in the display device (Block 80). Next, the user must select from a range of distances the proper distance between the camera and the subject of the photograph (Block 81) based on the dimensions of the photograph. The following description of the step of selecting the proper distance (comprising Blocks 82 through 84) illustrates the method as applicable to a 35 millimeter camera using a 35 millimeter lens. The particularities of the method will vary for different lens and film sizes, and this description is not intended to limit the method to these examples. The magnitude of the lower dimension of the photograph is the maximum allowable distance (upper value of the range) in feet between the camera and the subject (Block 82). Next the user takes the upper value of the range in feet and subtracts 1½ feet (Block 83) to determine the minimum allowable distance (lower value of the range) in feet between the camera and the subject. For example, if the camera uses 35 millimeter film, has a 35 millimeter lens, and the print size is to be 3½ inches by 5 inches, the photographer must stand 2 to 3½ feet away from the subject. If the print size is to be 4 inches by 6 inches, using the same lens and film size, the photographer must stand 2½ to 4 feet away from the subject. The user then selects a proper distance from the range (Block 84), holds the camera at the proper distance (Block 85), and takes the photograph (Block 86). In a preferred embodiment, the user repeats the steps in Blocks 84–86, starting with the proper distance being the lower value and incrementing by about 6 inches in each iteration until the highest value is reached. In other words, the user takes photos at about 6-inch intervals within the range of distances determined, including the end values of the range.

I claim:

1. A photo/event display device comprising:

at least two pages, each page comprising:

two layers of a first material, each of the two layers having edges joined by means for joining except for a region being left unjoined, leaving an opening to allow insertion of a photograph between the two layers;

a first side formed by an external surface of a first of the two layers and a second side formed by an external surface of a second of the two layers;

a first die cut through one of the first and second sides of the page;

first graphics printed on each side of the page and situated around the first die cut such that a subject of a photograph viewed through the die cut appears to be interacting with a scene depicted in the first graphics;

means for holding a photograph in the page such that the photograph may be viewed through the first die cut; and means for binding the pages to form a photo/event album comprising:

a second piece of the first material;

two creases dividing the second piece of material into three panels, a first and a third of the panels being of substantially equal dimensions, and a second of the panels, located between the first and third panels, being sized according to a number of pages to be inserted in the album;

second and third graphics printed on a external surface of the second piece of the first material on the first and third panels, respectively;

a second die cut in the first panel;

means for affixing the first and third panels to at least one page of the album, respectively, to form front and back covers of the album, respectively, each cover comprising at least two layers;

means for holding a photograph against an internal surface of one layer of the front cover such that a subject of the photograph is visible through the second die cut; and fourth graphics printed on an internal surface of one of a page and the front cover such that the fourth graphics are visible through one of the first and second die cuts, the fourth graphics demonstrating positioning and composition of a photograph in one of the page and the front cover, respectively, the fourth graphics being substantially identical to a respective one of the first and second graphics.

2. The display device of claim 1 wherein a film is affixed over one of the second die cut and the first die cut of a page to protect a photograph viewed therethrough.

3. The display device of claim 1 wherein one of the first, second, third, and fourth graphics are photographic images.

4. The display device of claim 1 wherein one of the first, second, third, and fourth graphics are photo-realistic images.

5. The display device of claim 1 wherein the first die cut of a page is situated and shaped such that it is adapted to be located where a face of a character depicted in the first graphics would be, resulting in the substitution of a face of a subject of a displayed photograph for the face of the character.

6. The display device of claim 1 wherein a portion of one of the second die cut and the first die cut of a page follows an outline of a character depicted in the first graphics.

7. The display device of claim 1 wherein a page includes:

a displayed photograph having a subject; and a piece of a second material affixed to one of the two layers and shaped to enhance the appearance of interaction between the subject of the displayed photograph and a scene depicted in the graphics.

8. The display device of claim 7 wherein the at least one of the at least two pages further includes:

means for storing and reproducing an audio input signal embedded in the piece of second material and including switch means for inducing playback of the stored audio signal, the switch means inducing playback of the stored audio input signal when at least a portion of the piece of second material is subjected to a compressive force.

9. A photo/event display device comprising:

at least two pages, each page comprising:

two layers of a first material, each of the two layers having edges joined by means for joining except for a region being left unjoined, leaving an opening to allow insertion of a photograph between the two layers;

a first side formed by an external surface of a first of the two layers and a second side formed by an external surface of a second of the two layers;

a first die cut through one of the first and second sides of the page;

first graphics printed on each side of the page and situated around the first die cut such that a subject of a photograph viewed through the die cut appears to be interacting with a scene depicted in the first graphics;

means for holding a photograph in the page such that the photograph may be viewed through the first die cut;

means for binding the pages to form a photo/event album; and second graphics printed on an internal surface of a page such that the second graphics are visible through the first die cut, the second graphics demonstrating positioning and composition of a photograph in the page, the second graphics being substantially identical to the first graphics.

10. The display device of claim 9 wherein the means for binding comprises:

a second piece of the first material;

two creases dividing the second piece of material into three panels, a first and a third of the panels being of substantially equal dimensions, and a second of the panels, located between the first and third panels, being sized according to a number of pages to be inserted in the album;

third and fourth graphics printed on a top surface of the second piece of the first material on the first and third panels, respectively;

a second die cut in the first panel;

means for affixing the first and third panels to at least one page of the album, respectively, to form front and back covers of the album, respectively, each cover comprising at least two layers; and means for holding a photograph against an internal surface of one layer of the front cover such that a subject of the photograph is visible through the die cut.

11. The display device of claim 9 wherein a background shown in a displayed photograph is adapted to be related to respective first graphics to enhance the appearance of interaction between a subject of the displayed photograph and a scene depicted in the first graphics.

12. The display device of claim 11 further comprising a displayed photograph including a background that is substantially identical to respective first graphics.

13. The display device of claim 12 wherein the background of the displayed photograph is a large piece of material with additional graphics printed thereon, the additional graphics being substantially identical to the first and second graphics.

14. The display device of claim 12 wherein the displayed photograph is a combination of a digitized image of a subject and a digitized image of the background.

15. The display device of claim 9 wherein a portion of one of a page and the front and back covers is formed such that it follows an outline of an image depicted in the graphics.

* * * * *